US011852019B1

(12) United States Patent
McCaffrey

(10) Patent No.: US 11,852,019 B1
(45) Date of Patent: Dec. 26, 2023

(54) AXIAL SEAL SYSTEMS FOR GAS TURBINE ENGINES

(71) Applicant: Raytheon Technologies Corporation, Farmington, CT (US)

(72) Inventor: Michael G. McCaffrey, Windsor, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/330,697

(22) Filed: Jun. 7, 2023

(51) Int. Cl.
*F01D 11/00* (2006.01)
*F01D 11/08* (2006.01)

(52) U.S. Cl.
CPC ..... *F01D 11/003* (2013.01); *F01D 11/08* (2013.01); *F05D 2240/55* (2013.01); *F05D 2250/711* (2013.01); *F05D 2250/75* (2013.01)

(58) Field of Classification Search
CPC ..... F01D 11/003; F01D 11/08; F01D 11/005; F01D 11/12; F01D 11/127; F05D 2240/55; F05D 2250/711; F05D 2250/75
See application file for complete search history.

(56) References Cited

U.S. PATENT DOCUMENTS

| | | | | |
|---|---|---|---|---|
| 4,425,078 | A * | 1/1984 | Robbins | F01D 25/12 415/138 |
| 9,845,695 | B2 * | 12/2017 | Budnick | F01D 25/30 |
| 10,247,022 | B2 * | 4/2019 | White | F16J 15/022 |
| 10,533,444 | B2 | 1/2020 | Lefebvre et al. | |
| 10,858,958 | B2 * | 12/2020 | Quennehen | F01D 25/246 |
| 2017/0350265 | A1 | 12/2017 | McLaughlin et al. | |

* cited by examiner

*Primary Examiner* — Courtney D Heinle
*Assistant Examiner* — Danielle M. Christensen
(74) *Attorney, Agent, or Firm* — SNELL & WILMER L.L.P.

(57) ABSTRACT

Disclosed herein is a seal comprising an annular ring comprising: an outer diameter surface having an outer diameter, an inner diameter surface, a first height measured from the outer diameter surface to the inner diameter surface, wherein a first ratio of the outer diameter to the first height is greater than 10:1; and a cross-sectional shape comprising: a central beam extending from an inner end to an outer end, the central beam including a central axis that defines an angle with a neutral axis of the cross-sectional shape, the angle being between 5 degrees and 25 degrees; a first flange extending axially from the inner end of the central beam in a first axial direction; and a second flange extending axially from the outer end of the central beam in a second axial direction, the second axial direction being opposite the first axial direction.

20 Claims, 5 Drawing Sheets

AXIAL SEAL SYSTEMS FOR GAS TURBINE ENGINES

FIELD

The present disclosure generally relates to gas turbine engines, and more particularly to blade outer air seal (BOAS) configurations of turbine sections or compressor sections of gas turbine engines.

BACKGROUND

During a typical rapid acceleration of a gas turbine engine, the rotors of the turbine and/or compressor expand radially outwardly more rapidly than the corresponding blade outer airseals (BOAS). This results in a pinch condition and excessive rub of the BOAS, resulting in an increased radial clearance between the rotor blade tip and the BOAS when the engine returns to a cruise operating condition. This increased clearance reduces performance of the gas turbine engine.

So called "dog-bone seals" have been used in the past and can generate significant axial loads, especially compared with conventional W-seals. However, conventional dog-bone seals cannot create sufficient axial loads in all cases.

SUMMARY

Disclosed herein is a seal. In various embodiments, the seal comprises: an annular ring comprising: an outer diameter surface having an outer diameter, an inner diameter surface, a first height measured from the outer diameter surface to the inner diameter surface, wherein a first ratio of the outer diameter to the first height is greater than 10:1; and a cross-sectional shape comprising: a central beam extending from an inner end to an outer end, the central beam including a central axis that defines an angle with a neutral axis of the cross-sectional shape, the angle being between 5 degrees and 25 degrees; a first flange extending axially from the inner end of the central beam in a first axial direction; and a second flange extending axially from the outer end of the central beam in a second axial direction, the second axial direction being opposite the first axial direction.

In various embodiments, the annular ring further comprises a first convex surface disposed axially opposite the first flange and a second convex surface disposed axially opposite the second flange. In various embodiments, the first convex surface comprises a first contact point between the annular ring and a first mating structure and the second convex surface comprises a second contact point between the annular ring and a second mating structure remain constant in response to pre-loading the seal from installation of the seal.

In various embodiments, the first flange and the central beam define a first relief cut, and wherein the second flange and the central beam define a second relief cut.

In various embodiments, a first axial surface of the first flange is spaced apart from the neutral axis by a first distance, a second axial surface of the second flange is spaced apart from the neutral axis by a second distance, and the first distance is substantially equal to the second distance. In various embodiments, the first flange includes a radially inner surface, the second flange includes a radially outer surface, the radially outer surface spaced apart from the radially inner surface by a second height, and a second ratio of the first height to the second height is 1.5:1 to 3.5:1.

In various embodiments, the cross-sectional shape is generally Z-shaped.

A turbine section of a gas turbine engine is disclosed herein. In various embodiments, the turbine section comprises: a turbine rotor disposed at an engine central longitudinal axis; a vane comprising a vane platform leg; a blade outer airseal ("BOAS") assembly including a plurality of BOAS segments arrayed circumferentially about the engine central longitudinal axis; and a seal compressed axially between an aft segment hook of each BOAS segment in the plurality of BOAS segments and the vane platform leg, the seal comprising a cross-sectional shape having a generally Z-shape, the seal including an outer diameter surface; an inner diameter surface, and a first height measured from the outer diameter surface to the inner diameter surface, wherein a first ratio of an outer diameter of the outer diameter surface to the first height is greater than 10:1.

In various embodiments, the seal further comprises a central beam extending from an inner end to an outer end, the central beam including a central axis that defines an angle with a neutral axis of the cross-sectional shape, the angle being between 5 degrees and 25 degrees. In various embodiments, the seal further comprises a first convex surface and a second convex surface, the first convex surface is disposed at the inner end of the central beam, and the second convex surface is disposed at the outer end of the central beam. In various embodiments, the first convex surface interfaces with the aft segment hook of each BOAS segment in the plurality of BOAS segments; and the second convex surface interfaces with the vane platform leg. In various embodiments, the seal further comprises a first flange and a second flange, the first flange extends axially from the inner end in a first direction, the second flange extends axially from the outer end in a second direction, and the second direction is opposite the first direction. In various embodiments, the first flange and the central beam define a first relief cut, and wherein the second flange and the central beam define a second relief cut. In various embodiments, a first axial surface of the first flange is spaced apart from the neutral axis by a first distance, a second axial surface of the second flange is spaced apart from the neutral axis by a second distance, and the first distance is substantially equal to the second distance.

In various embodiments, the first flange includes a radially inner surface, the second flange includes a radially outer surface, the radially outer surface spaced apart from the radially inner surface by a second height, and a second ratio of the first height to the second height is 1.5:1 to 3.5:1.

A gas turbine engine is disclosed herein. In various embodiments, the gas turbine engine comprises a combustor; a turbine section that is driven by combustion products from the combustor, the turbine section including: a turbine rotor disposed at an engine central longitudinal axis; a vane comprising a vane platform leg; a blade outer airseal ("BOAS") assembly including a plurality of BOAS segments arrayed circumferentially about the engine central longitudinal axis; and a seal compressed axially between an aft segment hook of each BOAS segment in the plurality of BOAS segments and the vane platform leg, the seal comprising a cross-sectional shape having a generally Z-shape, the seal including an outer diameter surface, an inner diameter surface, and a first height measured from the outer diameter surface to the inner diameter surface, wherein a first ratio of an outer diameter of the outer diameter surface to the first height is greater than 10:1.

In various embodiments, the seal further comprises a central beam extending from an inner end to an outer end, the central beam including a central axis that defines an angle with a neutral axis of the cross-sectional shape, the angle being between 5 degrees and 25 degrees. In various embodiments, the seal further comprises a first convex surface and a second convex surface, the first convex surface is disposed at the inner end of the central beam, and the second convex surface is disposed at the outer end of the central beam. In various embodiments, the first convex surface interfaces with the aft segment hook of each BOAS segment in the plurality of BOAS segments; and the second convex surface that interfaces with the vane platform leg. In various embodiments, the seal further comprises a first flange and a second flange, the first flange extends axially from the inner end in a first direction, the second flange extends axially from the outer end in a second direction, and the second direction is opposite the first direction.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein refers to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Disclosed herein is a seal comprising an annular ring (i.e., an annular seal). In various embodiments, annular seals with large ratios of outer diameter to height (i.e., a ratio of 10:1 or greater, or a ratio of 30:1 or greater, or a ratio of approximately 60:1), the physics in a stress state of the annular seal of the seal changes relative to an annular ring that has a smaller ratio of outer diameter to height (e.g., less than 10:1, or less than 5:1). For example, in response to having a large ratio of outer diameter to height, an applied moment around a perimeter of the annular ring. Accordingly, based on the physics in the stress state of the annular ring, the seal can be designed and configured to significantly increase a stiffness of the annular seal relative to a conical seal with little to no increase in stress, in accordance with various embodiments. In various embodiments, the seal can further maintain consistent contact points, allow for significant initial deflections, and/or have a consistent load application over a wide range of thermal expansion differences, in accordance with various embodiments. Stated another way, the seal allows for a large axial load for a given deflection without excessive stress and/or allow over compressing the seal without changing contact points of the seal, in accordance with various embodiments.

Figure 1:
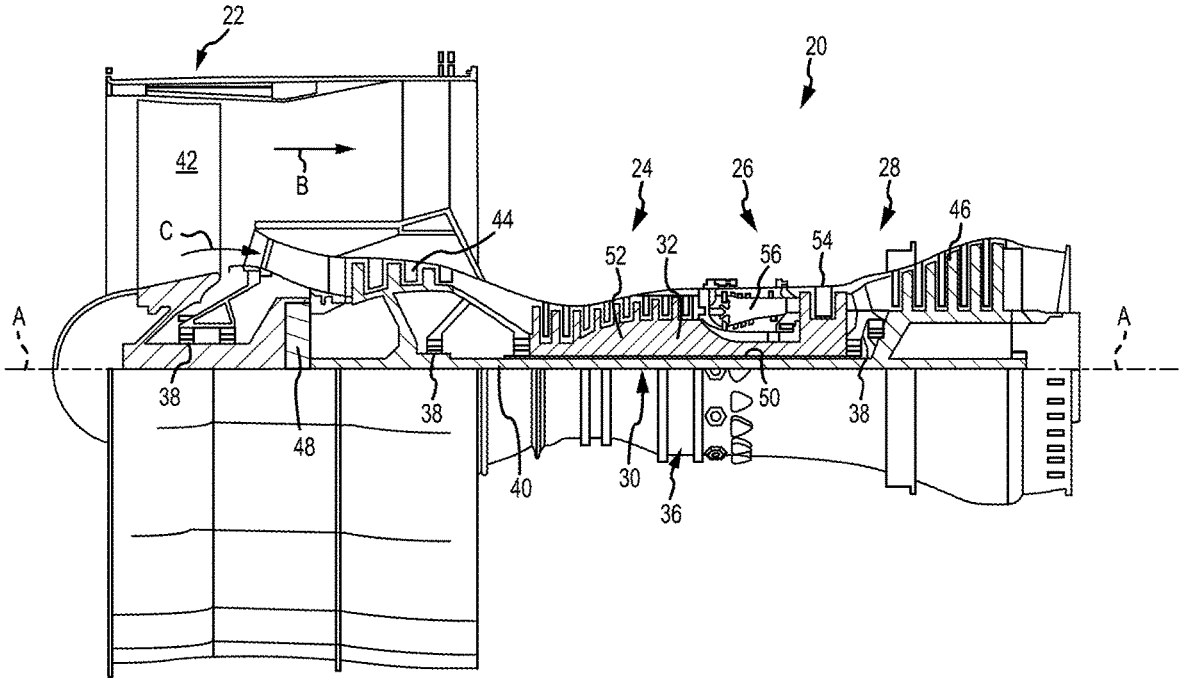
FIG. 1 illustrates a partial cross-sectional view of a gas turbine engine, in accordance with various embodiments.

Referring now to FIG. 1, a cross-sectional schematic view of a gas turbine engine 20 is illustrated, in accordance with various embodiments. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low-speed spool 30 and a high-speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low-speed spool 30 generally includes an inner shaft 40 that interconnects a fan 42, a low-pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low-speed spool 30. The high-speed spool 32 includes an outer shaft 50 that interconnects a high-pressure compressor 52 and high-pressure turbine 54. A combustor 56 is arranged in exemplary gas turbine 20 between the high-pressure compressor 52 and the high-pressure turbine 54. An engine static structure 36 is arranged generally between the high-pressure turbine 54 and the low-pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low-pressure compressor 44 then the high-pressure compressor 52, mixed and burned with fuel in the combustor 56, then expanded over the high-pressure turbine 54 and low-pressure turbine 46. The turbines 46, 54 rotationally drive the respective low speed spool 30 and high-speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low-pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

Figure 2:
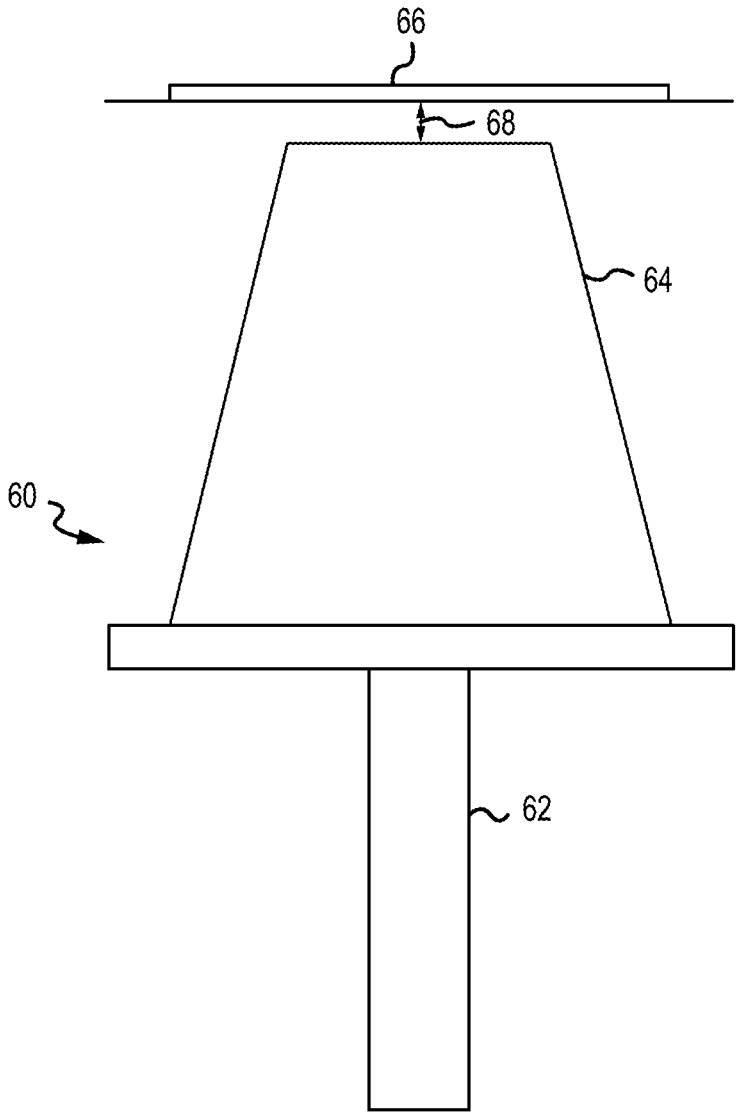
FIG. 2 illustrates a partial cross-sectional view of a rotor assembly, in accordance with various embodiments.

Referring now to FIG. 2, a partial cross-section of a rotor 60, (e.g., a rotor of the high-pressure turbine 54) is illustrated, in accordance with various embodiments. One skilled in the art, however, will appreciate that the present disclosure may be readily applied to other rotors of the gas turbine engine 20, for example, the low-pressure turbine 46, the low-pressure compressor 44, or the high pressure compressor 52. The rotor 60 includes a rotor disc 62 and a plurality of rotor blades 64 extending radially outwardly from the rotor disc 62. The rotor 60 is configured to rotate about the engine central longitudinal axis A. The rotationally stationary structure surrounding the rotor 60 includes a plurality of blade outer airseals (BOAS) 66. The BOAS 66 at least partially defines a blade clearance 68 between the plurality of rotor blades 64 and the BOAS 66.

Figure 3:
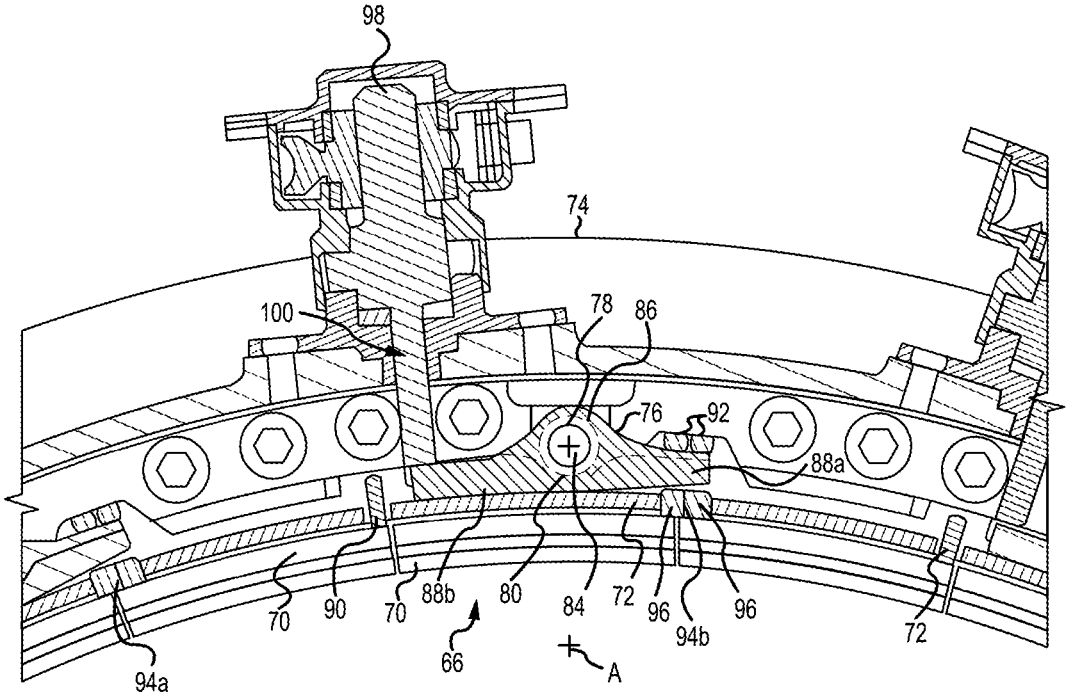
FIG. 3 illustrates a partial cross-sectional view of an embodiment of a blade outer airseal assembly.

Referring now to FIG. 3, a cross-sectional view of a BOAS 66 configuration is illustrated. The BOAS 66 includes a plurality of BOAS segments 70 arrayed circumferentially around the engine central longitudinal axis A. While the embodiment of FIG. 3 includes 30 BOAS segments 70, that number is merely exemplary and other quantities of BOAS segments 70 may be utilized. The BOAS segments 70 are retained in BOAS carriers 72 located radially outboard of the BOAS segments 70. In some embodiment, such as illustrated, each BOAS carrier 72 has two BOAS segments 70 secured thereto, while in other embodiments each BOAS carrier 72 may carry, for example, one or three BOAS segments 70. The BOAS carriers 72 are movably retained in a case member 74 located radially outboard of the BOAS carriers 72, so that the BOAS carriers 72 and thus the BOAS segments 70 are movable in a radial direction.

To effect movement of the BOAS segments 70, the BOAS carriers 72 are operably connected to a plurality of adjustment levers 76 secured to the case member 74. The adjustment levers 76 are each retained at the case member 74 via a pin 78 extending through a lever pivot 80 and a casing flange 82, best shown in FIG. 4. The pin 78 defines a lever axis 84 about which the adjustment lever 76 is rotatable. The pin 78, in this example, has a shoulder which engages a recess in casing flange 82 coupled with the cover plate 122, which both, combined, prevent relative motion of the pin 78 along lever axis 84. Referring again now to FIG. 3, the adjustment lever 76 has a hub portion 86 through which the pin 78 extends and two lever arms 88 extending opposite circumferential directions from the hub portion 86. The BOAS carriers 72 each have a carrier body 90 which supports the BOAS segments 70 and carrier flanges 92 at each circumferential end 94*a*, 94*b* of the BOAS carrier 72. The carrier flanges 92 extend radially outwardly from the carrier body 90 and each include a flange opening 96, such as a slot or hole through which a first lever arm 88*a* extends. As illustrated in FIG. 3, the first lever arm 88*a* extends through flange openings 96 of two circumferentially adjacent BOAS carriers 72. In operation, rotation of the adjustment lever 76 about the lever axis 84 moves the BOAS carriers 72 radially inwardly and outwardly depending on the direction of the rotation, and thus likewise adjusts a radial position of the BOAS segments 70. Because each first lever arm 88*a* extends through flange openings 96 of two adjacent BOAS carriers 72, operation of each adjustment lever 76 actuates two circumferentially adjacent BOAS carriers 72.

Figure 4:
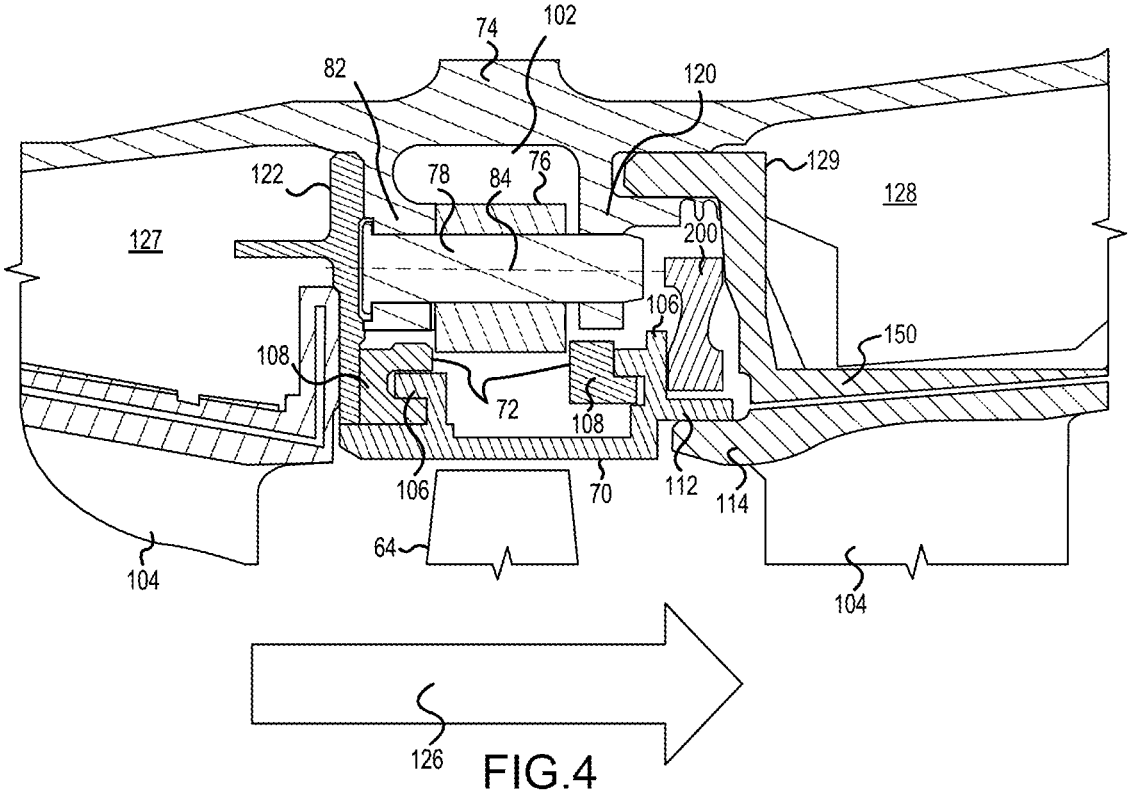
FIG. 4 illustrates a partial cross-sectional view of a blade outer airseal assembly, in accordance with various embodiments.

The rotation of the adjustment lever 76 is driven and controlled by an actuator 98 operably connected to the adjustment lever 76. In various embodiments, such as that illustrated in FIG. 3, the actuator 98 is a high-force, short-stroke linear actuator 98 positioned such that the actuator piston 100 contacts a second lever arm 88*b* of the adjustment lever 76. The force exerted on the second lever arm 88*b* by the actuator piston 100 drives rotation of the adjustment lever 76 about the lever axis 84, thus urging radial movement of, and controlling the position of the BOAS segments 70. The use of a lever increases the stroke length of the actuator 98 versus the relative motion of the BOAS segments 70. This improves the position control of the BOAS segment 70 because the larger stroke of the actuator enables more precision in the measurement system within the actuator 98 and reduces the size and weight of the actuator 98 for a given BOAS segment 70 load. While a linear actuator 98 arrangement is utilized in the embodiment of FIG. 3, one skilled in the art will readily appreciate that this is merely exemplary and that other types of actuators may be utilized in other embodiments. Referring to FIG. 4, the aerodynamic design of turbines typically specifies the smallest possible axial spacing between adjacent rows of blades 64 and stator vane 104 to improve performance and reduce weight. Thus, the axial spacing between adjacent stator vane 104 components is also minimized and results in relatively minimal axial space for the BOAS segments 70, BOAS carriers 72, and adjustment lever 76.

Referring again to FIG. 4, the adjustment levers 76, the pin 78, and the BOAS carriers 72 are located axially in a common cavity 102 defined in the case member 74 between axially adjacent stator vane 104 components. More particularly, the common cavity 102 is defined in part by the casing flange 82 and an aft flange 120 located rearward of the casing flange 82. The adjustment lever 76 is located between the casing flange 82 and the aft flange 120, with the pin 78 extending through both the casing flange 82 and the aft flange 120 and the adjustment lever 76 to retain the adjustment lever 76. In various embodiments, a cover plate 122 is located axially upstream of the casing flange 82, covering the casing flange 82 and the pin 78 to improve isolation and sealing from the upstream pressure cavity 127 into the common cavity 102.

In various embodiments, a seal 200 is located in the common cavity 102 at, for example, an interface of the aft segment hooks 106 and a vane platform leg 129 of a vane 150, to improve isolation and sealing to the downstream pressure cavity 128. It should be understood that the total air pressure within upstream pressure cavity 127 is greater than flow path 126 and the common cavity 102. Additionally, the pressure within common cavity 102 is greater than the downstream pressure cavity 128. Leakage losses reduce performance of the engine 20, and the inclusion of elements such as the cover plate 122 and the seal 124 further improves sealing and prevents leakage from the higher pressure within the common cavity 102 into the relatively lower pressure flow path 126. This compact structure in which the adjustment mechanism components are located in the same common cavity 102 reduces potential leakage points and reduces the impact of the adjustment structure on the overall engine 20 configuration, and minimizes the fluid leakage resulting from inclusion of the adjustment structure.

Figure 5:
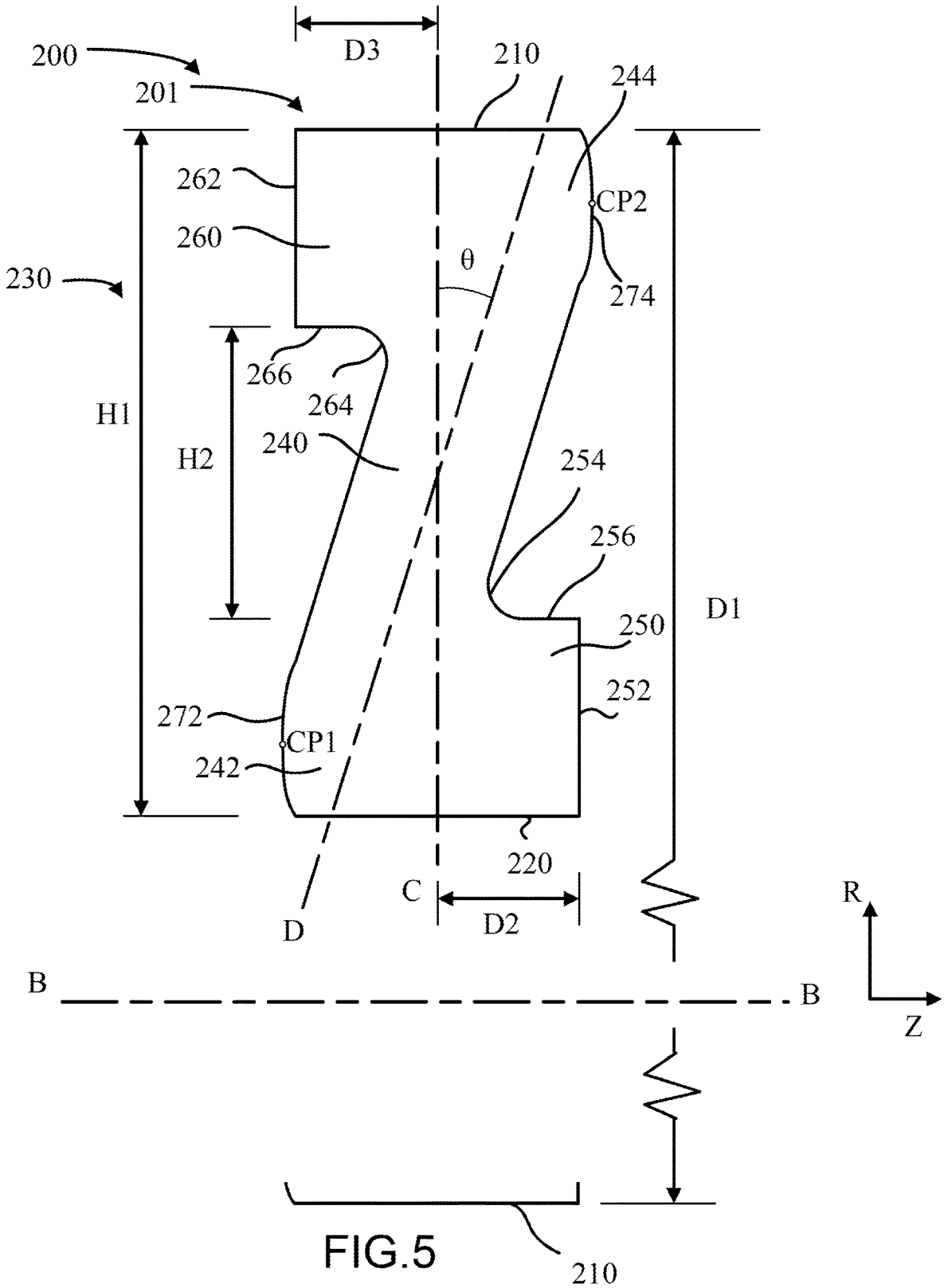
FIG. 5 illustrates a cross-sectional view of a seal for a rotor assembly, in accordance with various embodiments.

Referring now to FIG. 5, a cross-sectional view of a portion of the seal 200 from FIG. 4 is illustrated, in accordance with various embodiments. In various embodiments, the seal 200 comprises an annular ring 201. The annular ring 201 comprises an outer diameter surface 210, an inner diameter surface 220, a first height H1 measured from the outer diameter surface 210 to the inner diameter surface 220, and a cross-sectional shape 230. The cross-sectional shape 230 can be revolved continuously around a longitudinal axis B of the annular ring (i.e., revolved 360 degrees around the longitudinal axis B to form the annular ring 201.

The outer diameter surface includes an outer diameter D1. The outer diameter D1 described herein refers to a nominal outer diameter. "Nominal" as referred to herein refers to an as modeled dimension, not an as manufactured dimension. Stated another way, a manufactured seal that has manufacturing variations may result in an outer diameter that is different from the nominal outer diameter but within specified tolerances, or designed based on the nominal diameter. Such a manufactured seal would be considered to fall within the definition of having the nominal diameter D1, in accordance with various embodiments. A height H1 of the seal 200 is measured from the outer diameter surface 210 to the inner diameter surface 220. In various embodiments, the height H1 refers to a nominal height of the seal. A first ratio of the outer diameter D1 to the height H1 is greater than 10:1, or greater than 20:1, or greater than 30:1. In various embodiments, the ratio of the outer diameter D1 to the height H1 can be approximately 60:1. However, the present disclosure is not limited in this regard, and various ratios exceeding 60:1 would still be within the scope of this disclosure.

In various embodiments, the cross-sectional shape 230 comprises a central beam 240, a first flange 250, and a second flange 260. In various embodiments, the cross-sectional shape 230 includes a neutral axis C refers to a line or a plane through the seal 200 where no extension or compression of the seal occurs during compression of the seal 200. Stated another way, in response to compressing the seal 200 as described further herein, a stress along the neutral axis C is approximately zero.

In various embodiments, the first flange 250 extending axially from the inner end 242 of the central beam 240 in a first axial direction (i.e., a positive Z direction). In various embodiments, the second flange 260 extends axially from the outer end 244 of the central beam 240 in a second axial direction (i.e., a negative Z direction), the second axial direction being opposite the first axial direction. In this regard, the cross-sectional shape 230 of the seal 200 includes a generally Z-shape.

In various embodiments, the annular ring 201 further comprises a first convex surface 272 and a second convex surface 274. The first convex surface 272 can be disposed axially opposite an axial surface 252 defined by the first flange 250. Similarly, the second convex surface 274 can be disposed axially opposite an axial surface 262 of the second flange 260. In various embodiments, the first convex surface 272 and the second convex surface 274 define sealing surfaces of the seal 200. Stated another way, the first convex surface 272 is configured to interface with a mating surface of each BOAS segment in the plurality of BOAS segments 70. For example, the first convex surface 272 can interface with the aft segment hook 106 of a BOAS segment in the plurality of BOAS segments 70 from FIG. 4, in accordance with various embodiments. Similarly, the second convex surface 274 is configured to interface with a mating surface of the vane 150 (e.g., a mating surface of the vane platform leg 129).

In various embodiments, the convex surface 272, 274 can be configured to facilitate a consistent contact point between the convex surface 272, 274 and the respective mating surface (e.g., mating surface of the BOAS segment for the convex surface 272 and the mating surface of the vane 150 for the convex surface 274). Stated another way, the first convex surface 272 comprises a first contact point CP1 between the annular ring 201 and a first mating structure, and the second convex surface 274 comprises a second contact point CP2 between the annular ring 201 and a second mating structure that remain constant in response to preloading the seal from installation of the seal 200 as shown in FIG. 4.

In various embodiments, the first flange 250 and the central beam 240 define a first relief cut 254. Similarly, the second flange 260 and the central beam 240 define a second relief cut 264. In various embodiments, the relief cuts 254, 264 can facilitate the consistent contact points CP1, CP2 in response to installation of the seal 200. Stated another way, the seal 200 can be configured to rotate about a central circumferential line (e.g., defined by an intersection of the neutral axis C and the central axis D of the central beam 240) while maintaining the respective contact points with adjacent hardware. Stated another way, without the relief cuts 254, 264, the contact points CP1, CP2 could change during installation (i.e., move closer radially to the central circumferential line), which would result in an increase in stress in the seal 200, in accordance with various embodiments.

In various embodiments, the axial surface 252 of the first flange 250 is spaced apart from the neutral axis C by distance D2. Similarly, the axial surface 262 of the second flange 260 is spaced apart from the neutral axis C by a distance D3. In various embodiments, the distance D2 and the distance D3 are substantially equal. "Substantially equal" as referred to herein is within 5% of an average of the distances D2, D3, or within 2% of an average of the distances D2, D3 or within 1% of an average of the distances D2, D3. In various embodiments, the nominal distances D2, D3 are equal. However, the present disclosure is not limited in this regard.

The first flange 250 includes a radially inner surface 256. Similarly, the second flange 260 includes a radially outer surface 266. The radially outer surface 266 spaced apart (i.e., in a radially outward direction) from the radially inner surface 256 by a height H2. In various embodiments, a ratio of the height H1 of the seal 200 to the height H2 between the first flange 250 and the second flange 260 is between 1.5:1 and 3.5:1, or between 2:1 and 3:1.

Benefits, other advantages, and solutions to problems have been described herein regarding specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods, and apparatus are provided herein. In the detailed description herein, references to "one embodiment," "an embodiment," "various embodiments," etc., indicate that the embodiment described may include a particular feature, structure, or characteristic, but every embodiment may not necessarily include the feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, any of the above-described concepts can be used alone or in combination with any or all the other above-described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible considering the above teaching.

What is claimed is:

1. A seal, comprising:
an annular ring comprising:
an outer diameter surface having an outer diameter;
an inner diameter surface;
a first height measured from the outer diameter surface to the inner diameter surface, wherein a first ratio of the outer diameter to the first height is greater than 10:1; and
a cross-sectional shape comprising:
a central beam extending from an inner end to an outer end, the central beam including a central axis that defines an angle with a neutral axis of the cross-sectional shape, the angle being between 5 degrees and 25 degrees;
a first flange extending axially from the inner end of the central beam in a first axial direction; and
a second flange extending axially from the outer end of the central beam in a second axial direction, the second axial direction being opposite the first axial direction.

2. The seal of claim 1, wherein the annular ring further comprises a first convex surface disposed axially opposite the first flange and a second convex surface disposed axially opposite the second flange.

3. The seal of claim 2, wherein the first convex surface comprises a first contact point between the annular ring and a first mating structure and the second convex surface comprises a second contact point between the annular ring and a second mating structure remain constant in response to pre-loading the seal from installation of the seal.

4. The seal of claim 1, wherein the first flange and the central beam define a first relief cut, and wherein the second flange and the central beam define a second relief cut.

5. The seal of claim 1, wherein:
a first axial surface of the first flange is spaced apart from the neutral axis by a first distance,
a second axial surface of the second flange is spaced apart from the neutral axis by a second distance, and
the first distance is substantially equal to the second distance.

6. The seal of claim 1, wherein:
the first flange includes a radially inner surface,
the second flange includes a radially outer surface, the radially outer surface spaced apart from the radially inner surface by a second height, and
a second ratio of the first height to the second height is 1.5:1 to 3.5:1.

7. The seal of claim 1, wherein the cross-sectional shape is generally Z-shaped.

8. A turbine section of a gas turbine engine, comprising:
a turbine rotor disposed at an engine central longitudinal axis;
a vane comprising a vane platform leg;
a blade outer airseal ("BOAS") assembly including a plurality of BOAS segments arrayed circumferentially about the engine central longitudinal axis; and
a seal compressed axially between an aft segment hook of each BOAS segment in the plurality of BOAS segments and the vane platform leg, the seal comprising a cross-sectional shape having a generally Z-shape, the seal including an outer diameter surface, an inner diameter surface, and a first height measured from the outer diameter surface to the inner diameter surface, wherein a first ratio of an outer diameter of the outer diameter surface to the first height is greater than 10:1.

9. The turbine section of claim 8, wherein the seal further comprises a central beam extending from an inner end to an outer end, the central beam including a central axis that defines an angle with a neutral axis of the cross-sectional shape, the angle being between 5 degrees and 25 degrees.

10. The turbine section of claim 9, wherein:

the seal further comprises a first convex surface and a second convex surface, the first convex surface is disposed at the inner end of the central beam, and the second convex surface is disposed at the outer end of the central beam.

11. The turbine section of claim 10, wherein:

the first convex surface interfaces with the aft segment hook of each BOAS segment in the plurality of BOAS segments; and the second convex surface interfaces with the vane platform leg.

12. The turbine section of claim 10, wherein:

the seal further comprises a first flange and a second flange, the first flange extends axially from the inner end in a first direction, the second flange extends axially from the outer end in a second direction, and the second direction is opposite the first direction.

13. The turbine section of claim 12, wherein the first flange and the central beam define a first relief cut, and wherein the second flange and the central beam define a second relief cut.

14. The turbine section of claim 12, wherein:

a first axial surface of the first flange is spaced apart from the neutral axis by a first distance, a second axial surface of the second flange is spaced apart from the neutral axis by a second distance, and the first distance is substantially equal to the second distance.

15. The turbine section of claim 12, wherein:

the first flange includes a radially inner surface, the second flange includes a radially outer surface, the radially outer surface spaced apart from the radially inner surface by a second height, and a second ratio of the first height to the second height is 1.5:1 to 3.5:1.

16. A gas turbine engine, comprising:

a combustor;

a turbine section that is driven by combustion products from the combustor, the turbine section including:

a turbine rotor disposed at an engine central longitudinal axis;

a vane comprising a vane platform leg;

a blade outer airseal ("BOAS") assembly including a plurality of BOAS segments arrayed circumferentially about the engine central longitudinal axis; and a seal compressed axially between an aft segment hook of each BOAS segment in the plurality of BOAS segments and the vane platform leg, the seal comprising a cross-sectional shape having a generally Z-shape, the seal including an outer diameter surface, an inner diameter surface, and a first height measured from the outer diameter surface to the inner diameter surface, wherein a first ratio of an outer diameter of the outer diameter surface to the first height is greater than 10:1.

17. The gas turbine engine of claim 16, wherein the seal further comprises a central beam extending from an inner end to an outer end, the central beam including a central axis that defines an angle with a neutral axis of the cross-sectional shape, the angle being between 5 degrees and 25 degrees.

18. The gas turbine engine of claim 17, wherein:

the seal further comprises a first convex surface and a second convex surface, the first convex surface is disposed at the inner end of the central beam, and the second convex surface is disposed at the outer end of the central beam.

19. The gas turbine engine of claim 18, wherein:

the first convex surface interfaces with the aft segment hook of each BOAS segment in the plurality of BOAS segments; and the second convex surface that interfaces with the vane platform leg.

20. The gas turbine engine of claim 18, wherein:

the seal further comprises a first flange and a second flange, the first flange extends axially from the inner end in a first direction, the second flange extends axially from the outer end in a second direction, and the second direction is opposite the first direction.

* * * * *